United States Patent [19]

Bernard et al.

[11] 4,403,788

[45] Sep. 13, 1983

[54] SKI BRAKE

[75] Inventors: Jean Bernard; Jean Beyl, both of Nevers; Christian Campillo, Garchizy; René Guerreau, Montmarault; Daniel Le Faou, Varennes Vauzelles; Henri Peyre, Nevers, all of France

[73] Assignee: STE Look, Nivers, France

[21] Appl. No.: 286,195

[22] Filed: Jul. 23, 1981

[30] Foreign Application Priority Data

Aug. 4, 1980 [FR] France ..... 80 17167

[51] Int. Cl.[3] ..... A63C 7/10

[52] U.S. Cl. ..... 280/605

[58] Field of Search ..... 280/605, 12 PB; 188/5, 188/7

[56] References Cited

U.S. PATENT DOCUMENTS

| | | | |
|---|---|---|---|
| 4,101,145 | 7/1978 | Korger | 280/605 |
| 4,194,759 | 3/1980 | Svoboda | 280/605 |
| 4,234,206 | 11/1980 | Hofbauer et al. | 280/605 |
| 4,245,851 | 1/1981 | Krob et al. | 280/605 |

FOREIGN PATENT DOCUMENTS

| | | | |
|---|---|---|---|
| 2901899 | 8/1979 | Fed. Rep. of Germany | 280/605 |
| 2308389 | 11/1976 | France | 280/605 |
| 8000391 | 7/1980 | Netherlands | 280/605 |

*Primary Examiner*—David M. Mitchell

*Attorney, Agent, or Firm*—Jordan B. Bierman; Linda Bierman; C. Cornell Remsen, Jr.

[57] ABSTRACT

A ski brake comprising two pivotal arms having intermediate elbowed portions pivotally mounted in fixed bearings about an axis transverse to the ski, an operating pedal and a spring for restoring the pivotal arms to their braking position. A flexible and resilient metallic strip provides a connection between the control ends of the braking arms, is secured to an operating pedal actuated by the ski boot and is subjected to the action of a restoring spring and traction member. The ends of the resilient strip are fixed in cylindrical sleeves which are rotatably mounted on the control ends. When a boot is in position within the safety ski binding and the ski brake is therefore in a standby position of withdrawal above the ski, the resilient strip has a flat configuration and is located in practically the same plane as the traction member, thus preventing the appearance of a parasitic stress which would otherwise be liable to interfere with the operation of the ski binding.

5 Claims, 10 Drawing Figures

SKI BRAKE

This invention relates to a ski brake comprising two arms pivotally mounted about a horizontal axis located transversely with respect to the ski.

In some known types of ski brakes, the pivotal arms also provide the possibility of angular displacement in the plane of the ski. A resilient restoring member continuously urges the pivotal arms to an active position in which the braking ends project beneath the plane of the sole of the ski in a position of maximum relative spacing. When the ski boot engages within the safety ski binding, the braking ends are subjected to a movement of upward displacement to a point located above the plane of the ski, then undergo a movement of pivotal displacement towards each other. The braking ends are then in a withdrawn position above the ski and do not project outwards beyond the side edges of the ski. This is an advantage for the skier since the braking ends are not exposed to any danger of catching onto obstacles such as roots which may be present on the ski run.

When the ski boot is disengaged from the binding, the resilient restoring member initiates reopening of the braking system. Thus the braking ends first move away from each other and pass beyond the side edges of the ski, whereupon they undergo a downward pivotal displacement and are driven into the snow.

A very large number of devices have been proposed for controlling the movement of withdrawal of the braking arms. As a general rule, however, such devices prove to be complicated, delicate and costly.

However, a relatively simple ski brake of the type described is already known. In this design, a naturally curved resilient strip forming an operating pedal provides a connection between the pivotal arms at the control ends which are opposite to the braking ends.

When the ski brake is in the active braking position, the curved resilient strip tends to bring the control ends towards each other and consequently to move the braking ends away from each other.

When the ski boot is in position, it exerts pressure on the resilient strip which is consequently flattened. The resultant extension of the strip produces a relative outward displacement of the control ends and therefore a relative inward displacement of the braking ends.

When the boot is released from the ski binding, the resilient strip reverts to its convex shape, thus bringing the control ends closer together and therefore causing a relative outward displacement of the braking ends which accordingly pass on each side of the ski, then undergo a downward pivotal movement.

This ski brake is described for example in French Pat. No. 76 11752 (publication No. 2,308,389).

The disadvantage of this form of construction lies in the fact that the blade spring is flattened by the ski boot and consequently exerts a high upward pressure on the sole of the ski boot, thus constituting a parasitic stress which is liable to interfere with the normal operation of the safety ski binding. Since it proves necessary to employ a blade spring of relatively high strength in order to obtain efficient braking action, said parasitic stress may attain an excessive and dangerous level.

The aim of the invention is to overcome this disadvantage by designing a ski brake in which no parasitic stress is liable to interfere with the normal operation of the ski binding when the boot is in position on the ski and when the ski brake is in the upwardly withdrawn position above the ski.

In accordance with the invention, the flexible resilient strip is secured to an operating pedal which is capable of displacement by means of the ski boot and is pivotally mounted on the control ends of the braking arms about a horizontal axis which is transverse to the ski whilst the elastic restoring member is a traction member, one end portion of said traction member being attached to the ski and the other end portion of said member being adapted to produce action in the central region of the resilient strip in such a manner as to ensure that:

in the active braking position, the line of action of the traction member is inclined with respect to the face of the resilient strip at an angle such that said member causes flexural deformation of said strip, thus having the effect of inclining the control ends of the pivotal braking arms towards each other and therefore of outwardly displacing the braking ends with respect to each other;

in the raised position of withdrawal, the line of action of the traction member is approximately parallel to the face of the resilient strip which accordingly assumes a flat configuration, thus having the effect of restoring the control ends of the pivotal braking arms to their positions of relative outward displacement and therefore of inwardly displacing the braking ends of said arms with respect to each other.

When the boot is in position within the ski binding and the operating pedal is placed flat against the ski, it is possible to contemplate a design such that the transverse axis of pivotal motion of the braking arms, the line of action of the traction member and the resilient strip (which has been restored to its natural state of surface flatness) are coplanar. Under these conditions, the action of the traction member is zero on the one hand in order to produce a pivotal movement of the resilient strip about its own axis while lifting the operating pedal and on the other hand in order to produce a pivotal movement of the braking arms about the transverse axis. The ski brake is then in a condition of equilibrium and the parasitic stress developed beneath the ski boot is zero.

It will be apparent that, in actual practice, this arrangement must be avoided in order to ensure that the braking system can come into action at the time of disengagement of the ski boot. However, a small angular displacement of the traction member makes it possible to obtain a restoring force which is sufficient to actuate the ski brake while remaining insufficient to interfere with the safety ski binding.

These and other features of the invention will be more apparent upon consideration of the following description and accompanying drawings, wherein:

FIG. 1 is a view in perspective showing a first embodiment of the ski brake according to the invention, in the active braking position;

FIG. 1*a* is a longitudinal sectional view of the traction member which serves to restore the ski brake to its active braking position;

Figure 1:
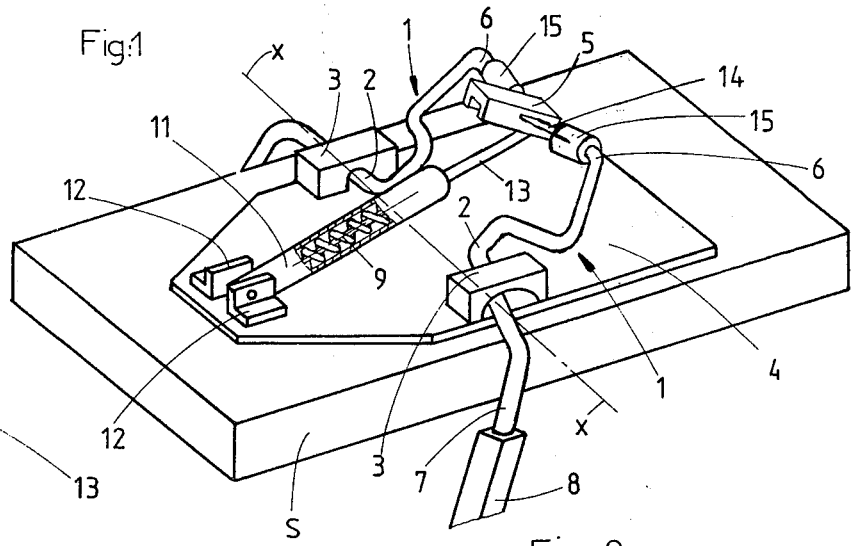
Figure 1A:
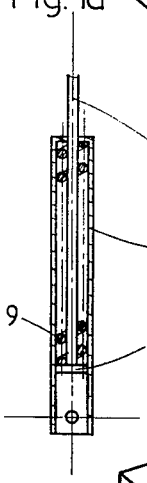
Figure 2:
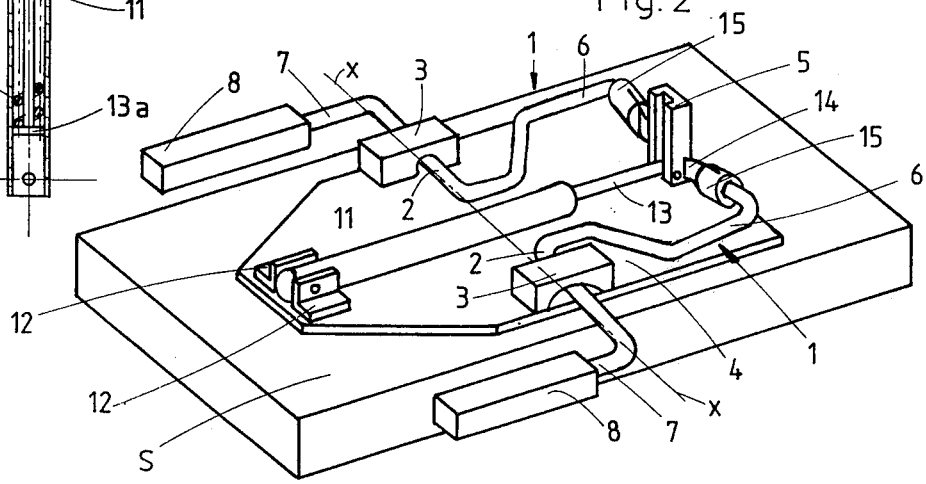
FIG. 2 is a view which is similar to FIG. 1 and shows the ski brake in an intermediate position in which the pivotal arms of the ski brake are located in a plane parallel to the plane of the ski but in which the braking ends of said pivotal arms have not yet moved towards each other.
Figure 3:
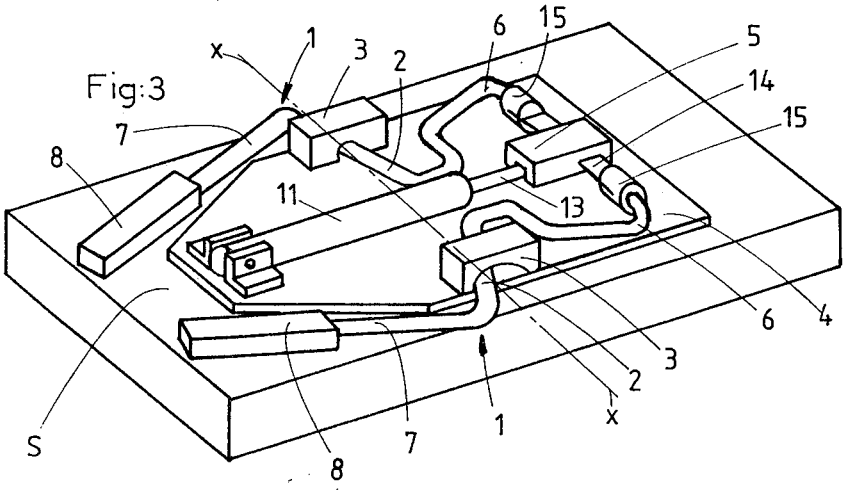
FIG. 3 is a view which is similar to FIGS. 1 and 2 and shows the ski brake in the withdrawn position, the braking ends of the pivotal arms being placed close together above the ski.

Referring to FIGS. 1 to 3 which illustrate a first embodiment of the invention, the ski brake comprises two braking arms 1 each constituted by a suitably shaped wire. Each arm 1 has an elbowed portion 2 pivotally mounted in a bearing 3 about a horizontal axis x—x which is transverse with respect to the ski S. The bearings 3 are carried by a base plate 4 which is secured to the ski S by suitable means such as screws (not shown in the drawings). The shape of the bearings 3 permits a certain relative angular displacement of the elbowed portions 2 with respect to the transverse axis x—x. In accordance with a well-known form of construction, each braking arm 1 is constituted by a control end 6 and by a braking end 7 fitted with an overmolded shoe 8. Each control end 6 has a transverse terminal portion on which is rotatably mounted a cylindrical sleeve 15. A flexible resilient strip 14 formed of suitable material such as spring steel and disposed transversely with respect to the ski provides a connection between the two cylindrical sleeves 15, the ends of the resilient strip 14 being inserted in said sleeves. The resilient strip 14 passes through an operating pedal 5 and is secured to this latter in its central region. An elastic restoring member in the form of a traction member is pivotally attached at one end to brackets 12 carried by the base plate 4 and at the other end to the operating pedal 5. In the example shown in the figures, the traction member comprises a cylindrical tube 11, a tie-rod 13 provided with a head 13*a* slidably fitted within the tube 11, and a compression spring 9 placed between the head 13*a* and the end wall of the tube.

This embodiment has the advantage of being particularly rugged and leak-tight; it would be possible, however, to provide a traction member of a different type such as a simple tension spring, for example.

The operation of the ski brake described in the foregoing is as follows:

By means of the traction rod 13 and the operating pedal 5, the spring 9 continuously exerts on the resilient strip 14 a force having a direction which is inclined at an angle with respect to the principal face of the strip 14 (and with respect to the operating pedal 5 carried by said strip). In consequence, the resilient strip 14 bends elastically and the cylindrical sleeves 15 move towards each other whilst their axes form a V (having a very wide angle) since they assume a slightly inclined position with respect to the transverse axis x—x. A correlative pivotal displacement of the intermediate elbowed portions 2 of the braking arms 1 takes place within the bearings 3, with the result that the braking ends 7 together with their shoes 8 are relatively displaced to the maximum extent in the outward direction, that is, towards the exterior of the ski S (as shown in FIG. 1).

During engagement of the boot in the ski binding, the boot exerts downward pressure on the operating pedal 5 and on the control ends 6 of the braking arms 1. Said arms pivot about the axes x—x so as to take up the intermediate position shown in FIG. 2, in which the braking shoes 8 are located in a plane above the ski but are still outwardly displaced to the maximum extent with respect to each other. As the boot continues to move downwards against the ski, the operating pedal 5 will now carry out a pivotal movement and cause the resilient strip 14 on which it is fixed to rotate about its own axis. The face of said strip therefore undergoes a movement of rotation from its initial position in which it was inclined at an angle with respect to the line of action of the spring 9 until it takes up a position which is practically parallel to the plane of the ski S as illustrated in FIG. 3. As this movement of rotation takes place, the face of the resilient strip 14 is progressively replaced by the edge in a vertical position with respect to the line of action of the spring 9. In consequence, the spring 9 produces action on a resilient strip 14 whose moment of inertia increases, with the result that it can no longer cause bending of the strip at the end of travel. During the movement of rotation, the resilient strip which had previously been curved by bending consequently assumes a flat configuration. The ends of the strip consequently move the cylindrical sleeves 15 away from each other and the axes of said sleeves are then located in a transverse direction. The intermediate portions 2 of the braking arms undergo a movement of rotation within the bearings 3 and the braking ends 7 (together with their shoes 8) move towards each other so as to take up a withdrawn position above the ski (as shown in FIG. 3). In this position, the line of action of the spring 9 as materialized by the traction rod 13 is practically located in the same plane as the flat strip 14, with the result that the force which tends to restore the ski brake to the active braking position is extremely small. In consequence, the parasitic stress exerted beneath the ski boot is negligible and gives rise to no disturbance.

When the boot is withdrawn from the ski binding, the spring 9 initiates upward displacement of the operating pedal 5 and resilient strip 14 through the intermediary of the traction rod 13. Said pedal and strip thus rotate progressively whilst the cylindrical sleeves 15 also rotate on the terminal portions of the control ends 6 of the braking arms 1. This movement is obtained by virtue of the fact that the tie-rod 13 is attached beneath the operating pedal 5 at a point which is displaced off-center with respect to the axis of the cylindrical sleeves 15. The principal face of the resilient strip 14 is again moved to a vertical position with respect to the axis of traction of the rod 13, said strip 14 is thus bent, the shoes 8 move away from each other and then pass beyond the edges of the ski (as shown in FIG. 2). The traction member 13 then lifts the control ends 6 of the braking arms 1; these latter undergo a pivotal movement about the transverse axis x—x whilst the shoes 8 come into the braking position in which they project beneath the plane of the sole of the ski (as shown in FIG. 1).

It will be noted that, in the case of a given resilient strip, the maximum deflection of the strip and the optimum correlative withdrawal of the braking arms are obtained when the traction member produces action at right angles to the strip as shown in the intermediate position of FIG. 2. However, although this arrangement has been described in the foregoing in the different embodiments illustrated in the drawings, it has been adopted solely for the sake of enhanced simplicity and is not perfect. In fact, the vertical position of the operating pedal makes it difficult for a skier to place a boot in the ski binding. It has been demonstrated in practice that, if the traction rod makes an angle of the order of 60° with the resilient strip, efficient withdrawal as well as easy boot engagement are both obtained at the same time.

Figure 4:
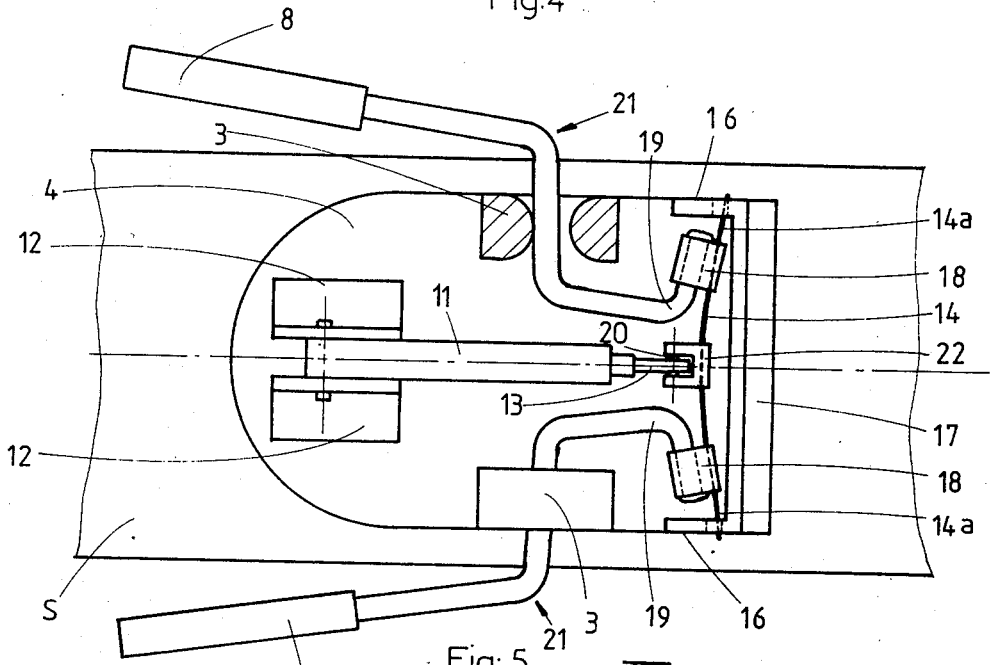
FIG. 4 is a part-sectional overhead plan view showing a second embodiment of the ski brake according to the invention and in an intermediate position, the braking ends being raised but not in the withdrawn position.
Figure 5:
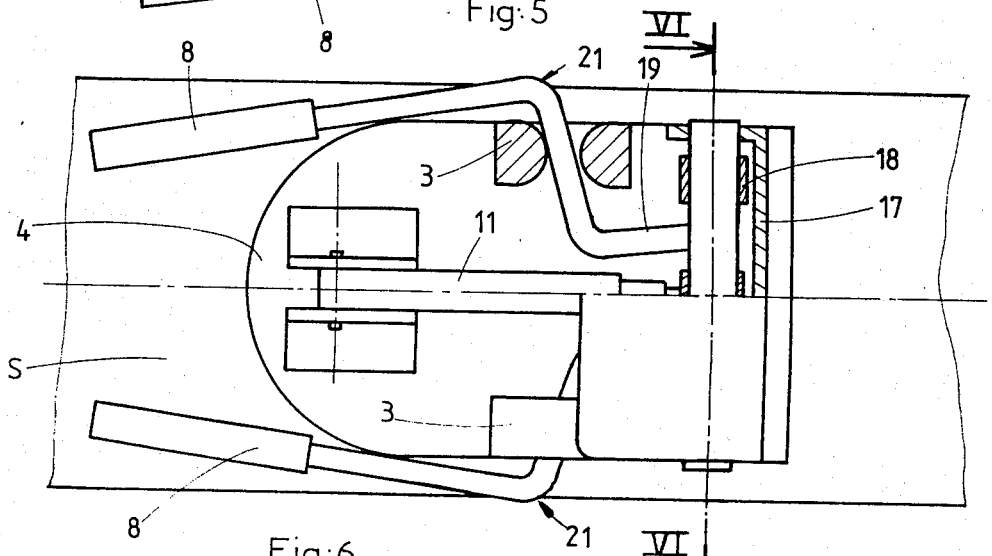
FIG. 5 is a view which is similar to FIG. 4 and showing the ski brake in the withdrawn position above the ski.
Figure 6:
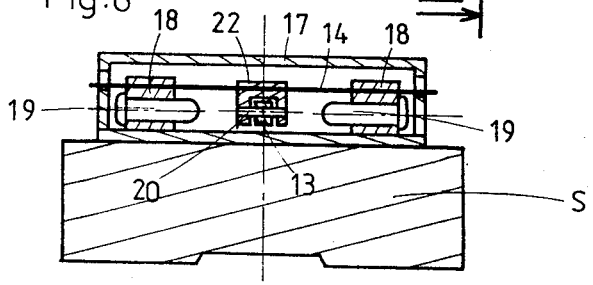
FIG. 6 is a transverse sectional view taken along line VI—VI of FIG. 5.

In the second embodiment of the ski brake which is illustrated in FIGS. 4 to 6, the end portions 14*a* of the resilient strip 14 are engaged and guided within openings formed in the side flanges 16 of the operating pedal 17 which is displaced in rotation by the ski boot and consequently causes pivotal displacement of the resilient strip 14 about its own axis. Furthermore, the end portions 14*a* pass through sleeves 18 which are similar to the sleeves 15 of the preceding embodiment and which are rotatably mounted on the control ends 19 of the braking arms 21. The traction rod 13 is pivotally mounted on a cross-pin 20 which is rigidly fixed to a yoke 22, the central region of the resilient strip 14 being passed through said yoke.

This alternative embodiment operates in the same manner as the previous embodiment except for the fact that the rotation of the resilient strip 14 about its own axis is no longer caused by its central region but by its end portions which are inserted in the side flanges 16 of the operating pedal 17.

Figure 7:
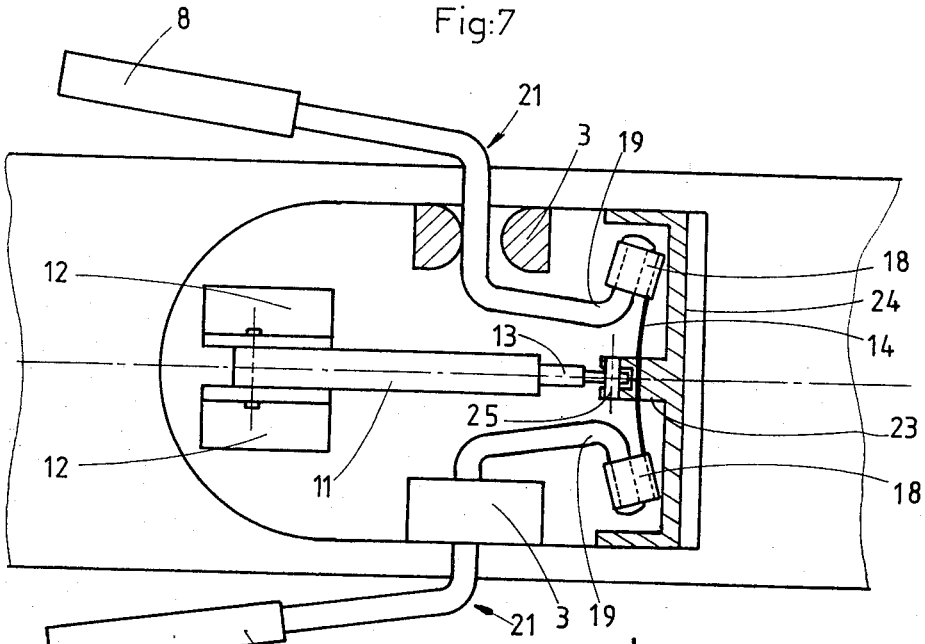
FIG. 7 is a part-sectional overhead plan view showing a third embodiment of the ski brake according to the invention and in an intermediate position, the braking ends being raised but not in the withdrawn position.
Figure 8:
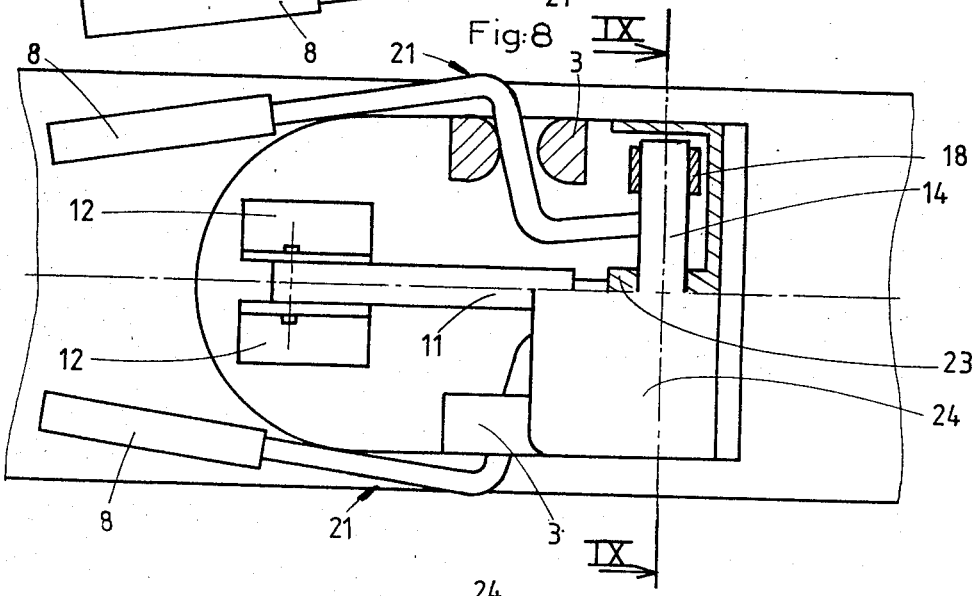
FIG. 8 is a view which is similar to FIG. 7 and shows the ski brake in the withdrawn position above the ski.
Figure 9:
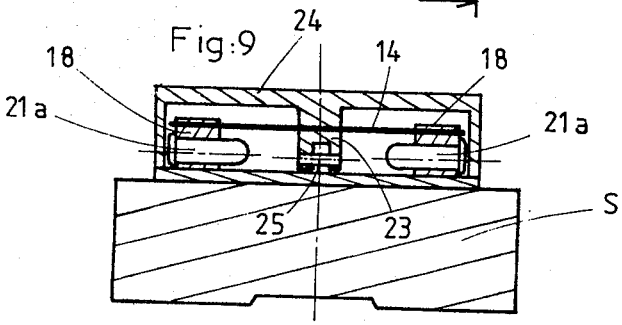
FIG. 9 is a transverse sectional view taken along line IX—IX of FIG. 8.

In the third embodiment illustrated in FIGS. 7 to 9, the central region of the resilient strip 14 is inserted in a central extension 23 of the operating pedal 24. Moreover, the ends of the strip are engaged in sleeves 18 which are rotatably mounted on the control ends 19 of the braking arms 21 as in the embodiment of FIGS. 4 to 6. In addition, the traction rod 13 of the restoring spring 9 is pivotally mounted on a cross-pin 25 mounted within the extension 23.

In the active braking position, the resilient strip 14 assumes the curved shape shown in FIG. 7 under the action of the restoring force exerted by the spring 9 on the extension 23 of the operating pedal 24. At the same time, the intermediate elbowed portions of the pivotal braking arms 21 are abuttingly applied within associated fixed bearings 3, said arms 21 being in the position shown in FIG. 7.

When the boot engages within the ski binding, it applies pressure on the operating pedal 24. The pedal is then displaced in pivotal motion and causes rotational displacement of the resilient strip 14 about its own axis until said pedal takes up a position in a plane which is parallel to the surface of the ski and contains the axis of the traction rod 13.

In the different embodiments described in the foregoing, no parasitic force is exerted by the resilient strip which connects the control ends of the braking arms when these latter are in the withdrawn position above the ski. This is due to the fact that the plane of said strip contains the axis of the force which restores the ski brake to its active position, thus constituting an essential advantage of the invention in comparison with ski-brake designs of the prior art.

What is claimed is:

1. A ski brake comprising a pair of arms each having a control end and a braking end, means pivotally mounting said arms about a horizontal axis transverse to the ski, said pivotally mounting means surrounding a portion of each arm with sufficient play to permit angular displacement of said arms in the plane of the ski, a flexible resilient strip disposed transversely of the ski and interconnecting the control ends of said braking arms, an elastic restoring member connected at one end to said ski and at its other end to the control ends of said braking arms through said flexible strip, whereby said restoring member continually urges said arms to the active braking position in which the braking ends project beneath the plane of the ski, and a control pedal fixedly attached to said flexible strip for pivotal movement about a horizontal axis transversely of said ski and concurrent rotational movement of said resilient strip, whereby in the braking position of said arms the line of action of said restoring member is inclined with respect to the face of the resilient strip at such an angle that said restoring member causes flexural deformation of said strip thereby having the effect of inclining the control ends of said braking arms toward one another and therefore outwardly displacing the braking ends of said arms with respect to one another, and in the raised position of said arms and the depressed pivotal position of said pedal the line of action of the restoring member is approximately parallel to the face of said resilient strip which therefore assumes a flat configuration, thus having the effect of restoring the control ends of said braking arms to their position of relative outward displacement, and therefore inwardly displacing the braking ends of said arms with respect to one another.

2. A ski brake according to claim 1, in which the central portion of said resilient strip is inserted in the operating pedal, and in which said other end of said restoring member is attached to said pedal, in combination with bearings supporting the control ends of said braking arms, and in which opposite ends of said resilient strip are respectively rigidly attached to said bearings.

3. A ski brake according to claim 1, in which the other end of said restoring member is directly attached to the central portion of said resilient strip, and in which said control pedal is formed with lateral flanges pivotally mounted on said ski and having openings therein in which the opposite ends of said resilient strip are respectively mounted for guidance in said openings.

4. A ski brake according to claim 1, in which said restoring member comprises a cylindrical tube having an end wall, a tie rod passing through said end wall and having a head forming a position slidably fitting within said tube, and a compression spring interposed between said head and said end wall.

5. A ski brake according to claim 1, in which said pedal is provided with lateral flanges pivotally mounted on said ski and is formed with a central extension having a transverse opening therethrough and projecting rearwardly toward and connected to said restoring member, and in which said resilient strip passes through said opening.

* * * * *